United States Patent [19]

Johnson

[11] Patent Number: 5,031,409

[45] Date of Patent: Jul. 16, 1991

[54] METHOD AND APPARATUS FOR IMPROVING THE EFFICIENCY OF ICE PRODUCTION

[75] Inventor: Kenneth Johnson, Monroe, N.C.

[73] Assignee: Tyson Foods, Inc., Springdale, Ark.

[21] Appl. No.: 553,860

[22] Filed: Jul. 16, 1990

[51] Int. Cl.[5] ..... F25C 1/12

[52] U.S. Cl. ..... 62/73; 62/352

[58] Field of Search ..... 62/73, 352, 81, 278

[56] References Cited

U.S. PATENT DOCUMENTS

| | | | |
|---|---|---|---|
| 2,739,457 | 3/1956 | Chapman | 62/107 |
| 3,167,930 | 2/1965 | Block et al. | 62/278 X |
| 4,044,568 | 8/1977 | Hagen | 62/73 |
| 4,324,109 | 4/1982 | Garland | 62/353 |
| 4,404,810 | 9/1983 | Garland | 62/73 |
| 4,813,239 | 3/1989 | Olson | 62/278 X |
| 4,979,371 | 12/1990 | Larson | 62/278 X |

*Primary Examiner*—William E. Tapolcai

*Attorney, Agent, or Firm*—Bell, Seltzer, Park & Gibson

[57] ABSTRACT

The invention is a method of harvesting ice formed on the freezing tube evaporator of a shell ice maker by trapping the gas phase refrigerant in the evaporator using a steam trap of the type that allows liquids to pass but not gases. The gas phase refrigerant can thus be maintained in the evaporator without circulating the gas phase refrigerant entirely through the refrigeration system. As a result, a greater fraction of the gas phase refrigerant in the evaporator condenses than would otherwise condense there if the gas phase refrigerant continued to flow without being trapped in the evaporator. The result is an increase in the heat transferred from the refrigerant to the evaporator and to the ice formed thereon and thus reduces the time and energy required to harvest the ice and correspondingly raises the efficiency of the entire ice making cycle.

20 Claims, 4 Drawing Sheets

METHOD AND APPARATUS FOR IMPROVING THE EFFICIENCY OF ICE PRODUCTION

FIELD OF THE INVENTION

The present invention relates to the production of ice using a refrigeration system and a two-phase refrigerant, and in particular relates to improving the efficiency of shell ice making machines that are cyclically operated to first produce ice and then harvest it.

BACKGROUND OF THE INVENTION

An ice making machine is a particular version of a generally well known device which may be referred to as a refrigerator or heat pump depending upon the specific application of the device. Mechanical refrigeration is the process of absorbing heat from a substance and transferring this heat elsewhere—usually to the atmosphere—through a cooling medium. The most common cooling mediums are water or air. In mechanical refrigeration systems, the transfer of heat is accomplished through the use of commercial refrigerants which are capable of absorbing heat and boiling to gases at relatively low pressures and temperatures, and then giving up the heat as they condense into liquids at higher pressures and temperatures.

In its basic form a refrigeration system includes a compressor, a condenser, and an evaporator as its main elements. Most systems also usually include some sort of liquid control system, a reservoir referred to as a receiver, and suitable piping and valves.

The compressor is the device in the system that draws the cold, heat carrying refrigerant in the gas phase from the evaporator at relatively low pressure and temperature. The compressor raises both the pressure and temperature of the gas to the point at which the gas will condense to a liquid at ordinary water or air temperatures, typically between about 85° F. and 105° F.

The refrigerant typically flows from the compressor to the condenser. The condenser transfers the heat absorbed by the refrigerant in the evaporator to the atmosphere through the condenser's own cooling medium, which in common applications is water or air. In general, the refrigerant will condense from the gas phase to the liquid phase at this point.

The evaporator is the cooling component of the system in which the pressure is reduced and the liquid refrigerant allowed to boil to a gas at a relatively low temperature. This change of state absorbs heat from the substance surrounding the evaporator.

The liquid control system pipes and pumps the refrigerant from the evaporator, to the compressor, to the condenser, and back to the evaporator. Additionally, the system includes a liquid control device immediately ahead of the evaporator. This is typically an expansion or float valve which meters the proper amount of liquid refrigerant to the evaporator and which seals the high pressure and low pressure sides of the system from one another. The receiver stores a sufficient quantity of high pressure liquid refrigerant to insure a constant supply of liquid refrigerant to the liquid control device at all times.

A shell ice maker is a particular type of refrigeration system in which the evaporator takes the form of vertically oriented stainless steel tubes upon which water is sprayed and freezes into ice as the evaporator is cooled. U.S. Pat. Nos. 2,739,457 to Chapman and 4,324,109 and 4,404,810, both to Garland, are illustrative of shell ice making machines. Other background information on shell ice making machines is available from the Frick Division of York International Corporation of Waynesboro, Pa.

In a shell ice maker, water is sprayed onto the stainless steel tubes which make up the evaporator and freeze in place upon those tubes. A typical refrigerant for such a shell ice maker is ammonia or one of the appropriate chlorofluorocarbons. In order to harvest ice from the ice maker, however, some mechanism must be incorporated for removing ice from the stainless steel tubes. The most common method is to operate the entire ice maker on a timed cycle. In the major portion of the cycle, liquid refrigerant is pumped to the evaporator and allowed to evaporate, thereby cooling the evaporator and encouraging ice to freeze on the stainless steel tubes as water is sprayed upon them.

In the shorter portion of the cycle, and in order to remove the ice from the tubes, the ice maker also includes a series of pipes and valves for directing the warmer gas phase refrigerant into the stainless steel tubes of the evaporator. The warmer gas phase refrigerant in turn warms the tubes and melts at least a small portion of the ice on the exterior of the tubes so that the remainder will tend to slide off under the influence of gravity. When the ice strikes the lower portions of the ice maker, it breaks into pieces, and if necessary, is subjected to further mechanical breaking action to reduce the size of the pieces even further.

Such a typical shell ice making device will include the usual elements of the compressor and the condenser along with a common liquid-gas header for some or all of the stainless steel tubes of the evaporator, and a liquid-gas accumulator for regulating the flow of gas and liquid throughout the entire system. In a typical arrangement, the accumulator is physically located above the header so that liquid refrigerant can be added to the evaporator simply by allowing it to flow downwardly under the influence of gravity from the accumulator, into the header and then into the freezing tubes.

Refrigerant in the gas phase, however, will not automatically flow into the freezing tubes and must be specifically drawn out of the accumulator, compressed, and pumped into the freezing tubes. This pumping action, as would be expected, requires that a sufficient amount of mechanical energy be expended in order to draw the gas phase refrigerant from the evaporator, through the piping and liquid control system, into the accumulator, and finally into the compressor.

In typical ice making operations, an ice making cycle is selected that will produce a certain amount of ice and is represented by a certain time period during which liquid refrigerant must be circulated through the evaporator. Correspondingly, the harvesting cycle is likewise represented by a certain period of time during which gas phase refrigerant must be circulated through the evaporator to harvest the ice just grown. As an example, in a ten minute ice making cycle, liquid refrigerant would be circulated through the evaporator tubes for about seven and half minutes and then gas phase refrigerant would be cycled through for about two and half minutes. Thus, approximately twenty-five percent of every cycle is spent harvesting ice, not because it takes the ice that long to fall from the tubes, but because it takes that proportion of time to circulate enough of the gas phase refrigerant through the entire system to transfer enough heat to melt the ice sufficiently for it to fall.

As another disadvantage of this system, when pumping gas throughout the system, the suction pressure of the compressor is raised rather significantly, often to seventy pounds or higher before the ice defrosts and harvests. As might be expected, this uses significant amounts of energy. As known to those familiar with such systems, the suction required from the compressor also becomes greater when the ambient temperature is warmer.

Finally, the proportion of any given cycle used to harvest ice represents energy—and therefore mechanical and economic resources—used to pump gas phase refrigerant throughout the system. Alternatively, if the ice could be harvested more efficiently, that same energy could be used to form more ice, or the energy needed to form any given amount of ice could be correspondingly reduced.

There thus exists the need to reduce the energy consumption of the ice making cycle as well as to reduce the load on the mechanical equipment such as the condensers and the compressors, as well as a lessening of the proportionate time required to form and then harvest any particular amount of ice.

OBJECT AND SUMMARY OF THE INVENTION

It is thus an object of the present invention to increase the efficiency of ice making techniques and apparatus in such devices. The invention meets this object by providing a method of harvesting ice formed on such an evaporator by trapping the gas phase refrigerant in the evaporator using a steam trap of the type that allows liquids to pass but not gases. The gas phase refrigerant can thus be maintained in the evaporator without circulating the gas phase refrigerant entirely through the system. As a result, a greater fraction of the gas phase refrigerant in the evaporator condenses than would otherwise condense there if the gas phase refrigerant continued to flow without being trapped in the evaporator. The invention resultingly increases the heat transferred from the refrigerant to the evaporator and to the ice formed thereon and thus reduces the time and energy required to harvest the ice and correspondingly raises the efficiency of the entire ice making cycle.

The foregoing and other objects, advantages and features of the invention, and the manner in which the same are accomplished, will become more readily apparent upon consideration of the following detailed description of the invention taken in conjunction with the accompanying drawings, which illustrate preferred exemplary embodiments, and where:

DETAILED DESCRIPTION OF THE INVENTION

The invention comprises a method and apparatus for the production of ice using a refrigeration system and a two-phase refrigerant. In particular, the invention improves the efficiency of shell ice making machines which operate in alternating cycles to first produce ice and then to harvest ice. The drawings illustrate particular features of a shell ice maker and the invention is best understood with respect to these features and their operation.

Figure 1:
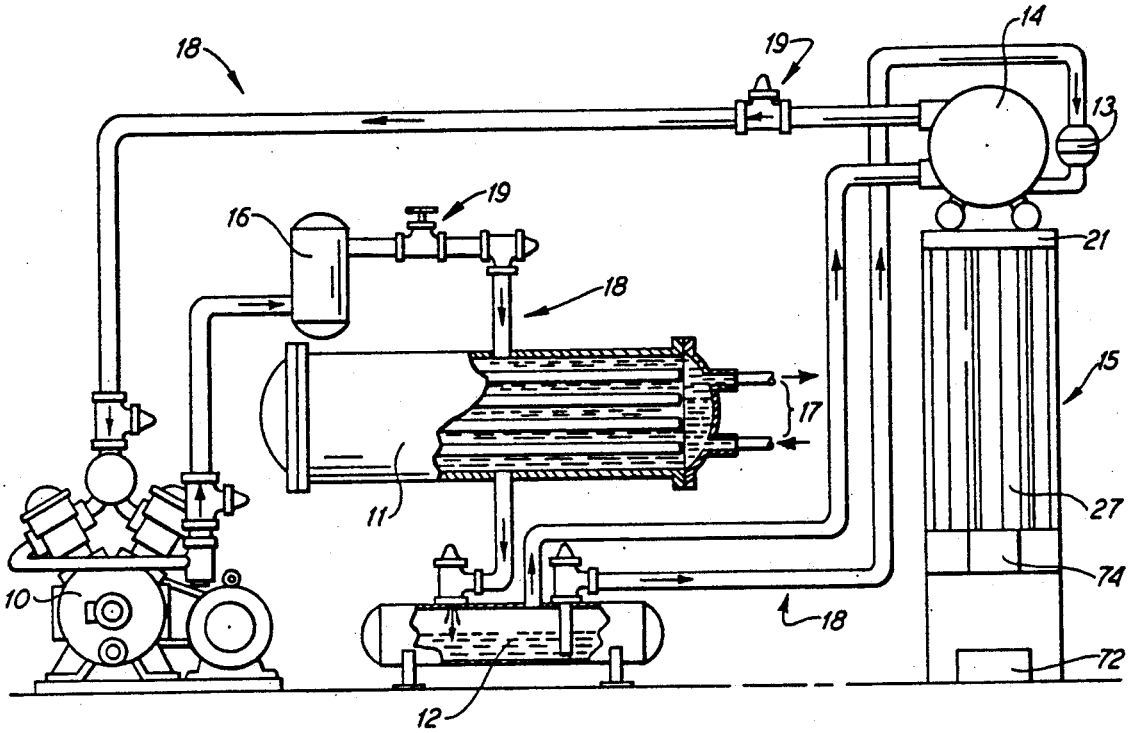
FIG. 1 is a partially cross-sectioned side elevational view of a shell ice maker.

FIG. 1 illustrates a shell ice maker apparatus consisting of a compressor 10 for receiving a two phase refrigerant in the gas phase and then changing the refrigerant from a low pressure gas phase to a high pressure gas phase, a condenser 11 in communication with the compressor for transferring heat previously absorbed by the refrigerant away from the apparatus and returning the refrigerant to the liquid state, a receiver 12, a float valve 13, a liquid-gas accumulator 14, and an evaporator 15 in fluid communication with the condenser and with the compressor for receiving refrigerant in the liquid phase from the condenser and then allowing the refrigerant to change from the liquid phase to the gas phase while absorbing heat from the evaporator and its surroundings to thereby cool the evaporator and its surroundings.

A series of pipes and valves, broadly designated 18 and 19 respectively in FIG. 1 and discussed in more detail with respect to the remaining drawings, serve as the means for circulating refrigerant from the compressor to the condenser, from the condenser to the evaporator, and from the evaporator to the compressor.

The compressor 10 draws cold refrigerant gas from the top of the accumulator 14 and compresses the gas, raising its pressure and temperature. This high temperature, high pressure gas is then piped to the condenser 11 after first passing through an oil separator 16. In the condenser 11, heat previously absorbed by the gas refrigerant is transferred away from the apparatus to a cooling medium, generally air or water, which circulates through the condenser 11 using the pipes 17. The transfer of heat causes refrigerant to condense from the gas phase to the liquid phase.

Figure 2:
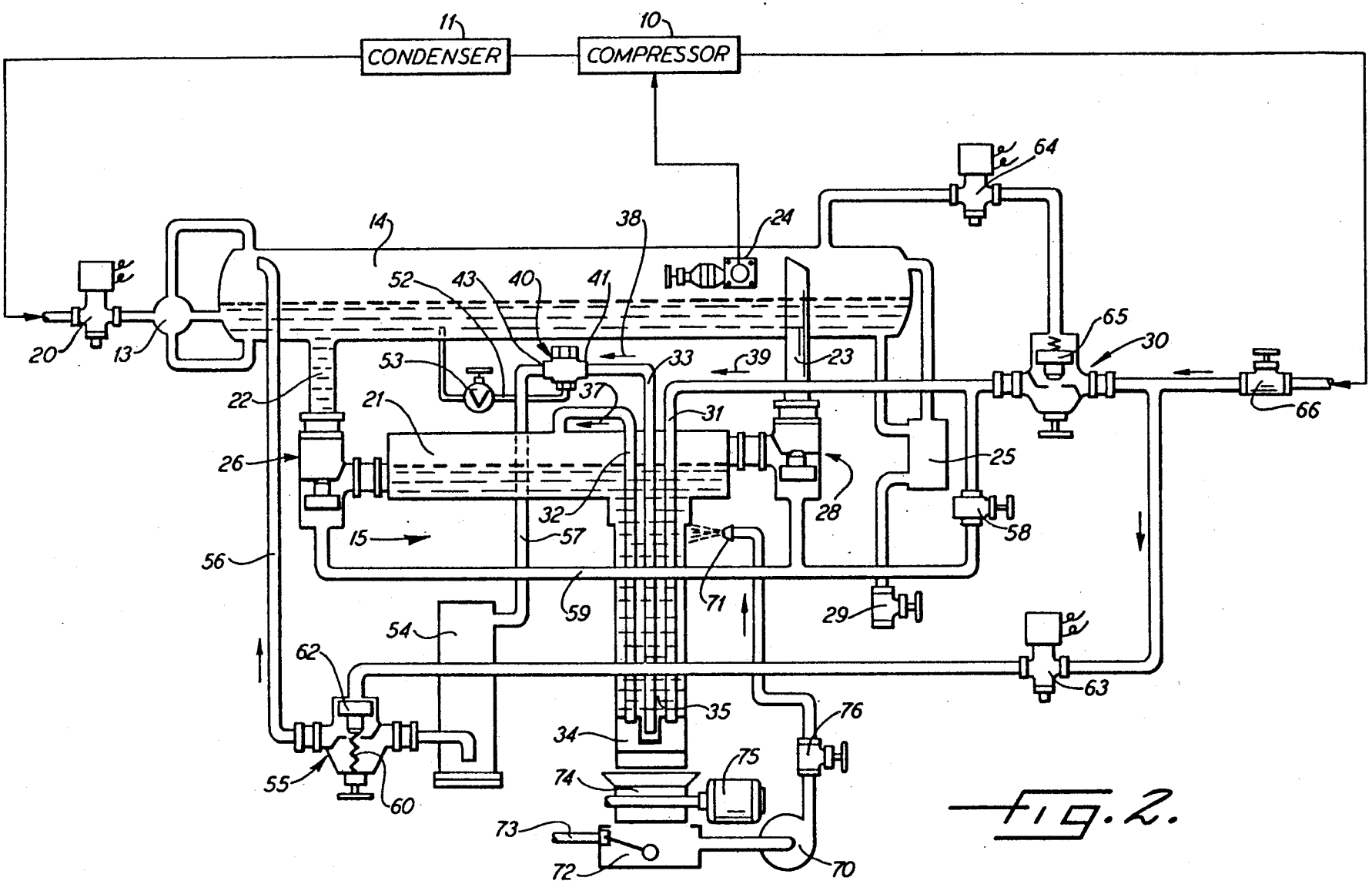
FIG. 2 is a schematic view of a conventional ice maker modified according to the present invention.

Liquid refrigerant from the condenser 11 is collected in the receiver 12, which continuously supplies liquid to the accumulator 14 through the float valve 13. The flow of liquid from the receiver 12 to the float valve 13 is controlled by the liquid line solenoid valve 20 as shown in FIG. 2. The float valve 13 meters the proper amount of liquid refrigerant supplied to the accumulator 14 and ultimately to the evaporator 15. Additionally, the float valve 13 maintains a seal between the high and low pressure sides of the refrigeration system.

FIG. 2 shows the accumulator 14 and evaporator 15 systems in greater detail. The evaporator is in the form of a plurality of stainless steel tubes 27 in communication with a common liquid-gas header 21, only one of which tubes is illustrated in FIG. 2 in order to clarify the overall operation of the ice maker. The accumulator 14 is in fluid communication with the liquid-gas header 21 and between the evaporator 15 and the condenser 11, and conducts the flow of liquid refrigerant between the condenser 11 (shown schematically) and the liquid-gas header 21.

The accumulator 14 is connected to the liquid-gas header 21 by a liquid down leg 22 and a gas return leg 23. Gas which collects in the top portion of the accumulator 14 is returned to the compressor 10 through the suction opening 24. An oil collecting pot 25 and corresponding oil drain valve 29 are also connected to the accumulator 14 and are used to remoVe waste materials.

Liquid flow from the accumulator 14 is controlled by the liquid piston valve 26. When the valve 26 is open, gravitational force causes the movement of liquid from the accumulator 14 into the liquid-gas header 21 and the stainless steel freezing tubes 27, as the accumulator is typically physically located above the header. The gas piston valve 28 works in an analogous manner in that when the valve is open, gas escapes from the header 21 into the accumulator 14. The valves 26 and 28 are closed by hot gas discharge pressure when it is allowed to pass to them through the pilot operated hot gas valve 30, valve 58, and the piping 59.

The multiple stainless steel freezing tubes 27, upon which the ice forms, are welded to the liquid-gas header 21. Water is placed on the exterior of the evaporator—i.e. the tubes—to form ice when the refrigerant in the evaporator is in the liquid phase. Means shown as the recirculating pump 70 and the nozzle 71 place water in thermal communication with the evaporator for cooling and freezing the water into ice.

As stated above, in preferred embodiments, the evaporator comprises a vertically oriented stainless steel tube and the means for placing water in thermal communication with the evaporator comprises a water spray directed at the exterior of the stainless steel tube so that the water forms ice when the refrigerant in the stainless steel tube evaporator is in the liquid phase, and for allowing a portion of the ice that forms on the exterior of the tube to melt when the evaporator is cyclically warmed by gas phase refrigerant so that substantially all of the ice on the tube is encouraged to fall from the tube when the evaporator is cyclically warmed.

Figure 3:
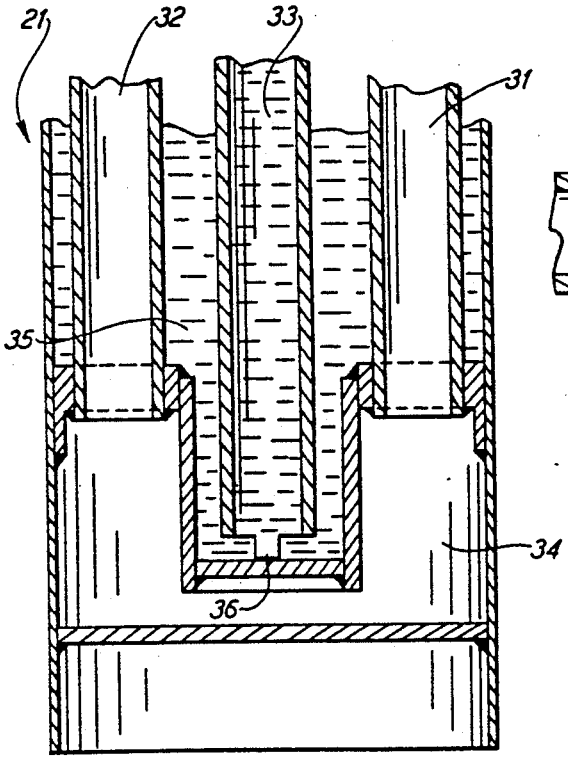
FIG. 3 is a cross-sectional view of the lower portion of one of the stainless steel freezing tubes of a shell ice maker.
Figure 6:
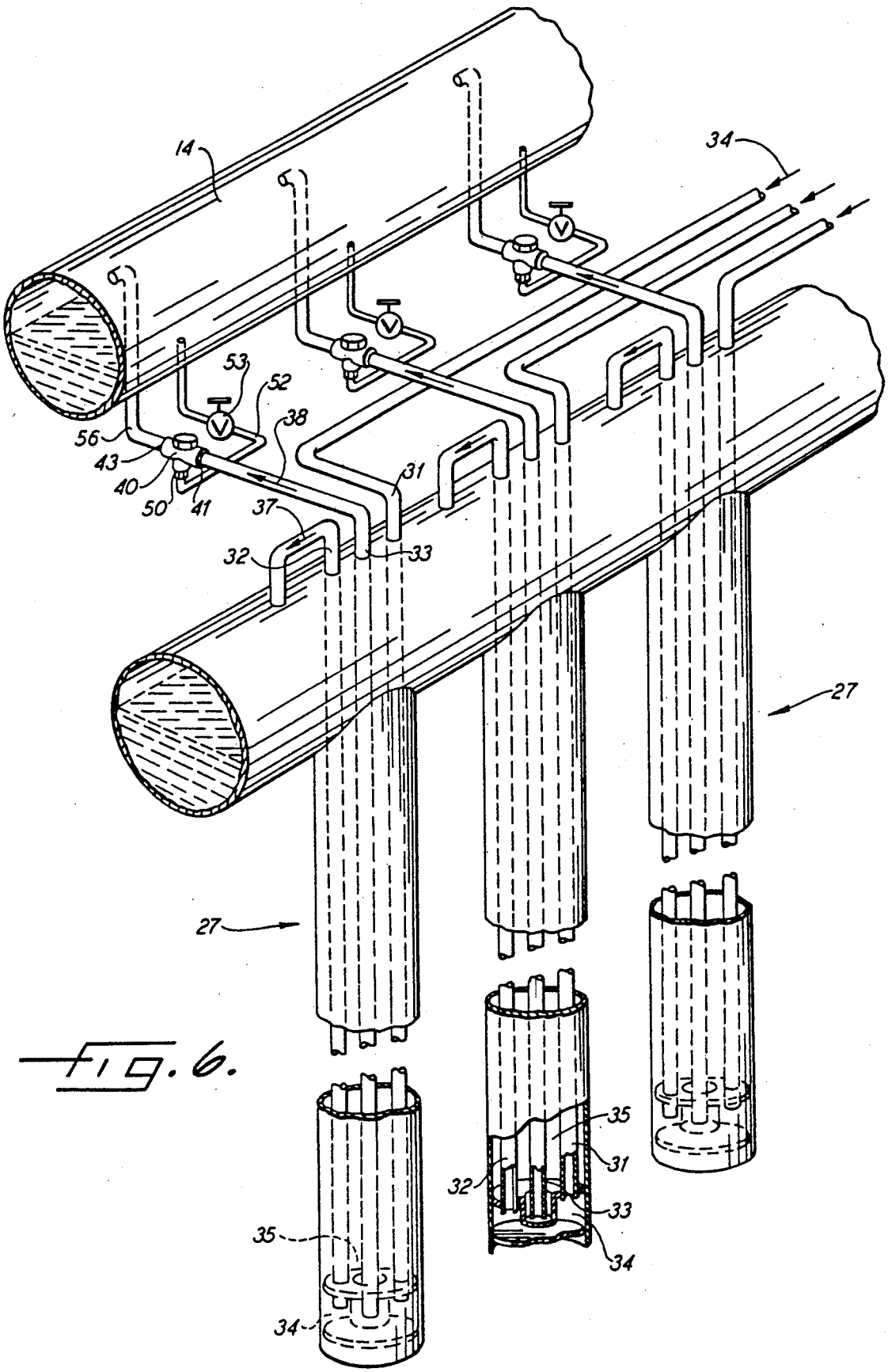
FIG. 6 is a perspective view of several of the freezing tubes, a common header, and an accumulator, and the refrigerant flow paths therebetween.

As shown in FIGS. 2 and 6, each of the tubes 27 has first, second, and third pipes 31, 32, and 33 respectively, internal to it. These pipes run the length of the tube 27 and then pass through and out the top of the liquid-gas header 21. A first pipe 31 directs hot discharge gas from the pilot operated hot gas valve 30 down the length of the freezing tube 27, as shown by directional arrow 39, to the gas cavity 34 at the bottom of the tube. A cross-section of the lower part of the freezing tube 27 is shown in FIG. 3.

The gas cavity 34 connects the first pipe 31 to the second pipe 32 and is sealed to keep out the liquid refrigerant which fills the remainder of the freezing tube 27. The second pipe 32 then directs the gas from the gas cavity 34, up the length of the freezing tube 27, out of the liquid-gas header 21, and then back into the top of the header as shown by directional arrow 37. The third pipe 33 is positioned near the bottom of the liquid chamber 35 of the freezing tube 27 and has an opening 36 so that the liquid refrigerant can be forced out of the liquid chamber through the pipe. The third pipe 33 transverses the length of the freezing tube 27, passes through the liquid-gas header 21, and eventually returns to the accumulator through the liquid blowout collecting pot 54 and the liquid return defrost valve 55. The apparatus thus includes means for alternatively sending gas phase refrigerant to the evaporator to cyclically warm the evaporator from time to time as may be desirable.

With respect to this portion of the operation of the system, the invention thus comprises circulating a two phase refrigerant into an evaporator in the liquid phase to cool the evaporator, placing water on the exterior of the evaporator to form ice when the refrigerant in the evaporator is in the liquid phase, and then harvesting the ice formed on the evaporator by trapping the gas phase refrigerant in the evaporator using a steam trap of the type that allows liquids to pass, but not gases, so that the gas phase refrigerant can be maintained in the evaporator without circulating the gas phase refrigerant entirely through the system to thereby condense a greater fraction of the gas phase refrigerant in the evaporator than would condense there if the gas phase refrigerant continued to flow without being trapped in the evaporator, and to thereby increase the heat transferred from the refrigerant to the evaporator and to the ice formed thereon and thus reduce the time and energy required to harvest the ice and correspondingly raise the efficiency of the entire ice making cycle.

In the illustrated embodiment, the third pipe 33 connects to a steam trap valve 40, typically made of stainless steel, positioned between the header 21 and the accumulator 14, and connected as shown in FIG. 2. Liquid flows through the third pipe 33 in the direction indicated at 38. More broadly, the steam trap valve provides means positioned in the refrigerant circulating means between the evaporator and the condenser for allowing the passage of liquids from the evaporator to the compressor while minimizing or stopping the passage of gases to thereby maintain gas phase refrigerant in the evaporator for warming purposes without circulating gas phase refrigerant entirely through the system and to thereby reduce the work required by the compressor following any cyclical warming of said evaporator and to correspondingly increase the efficiency of the ice making process.

Figure 4:
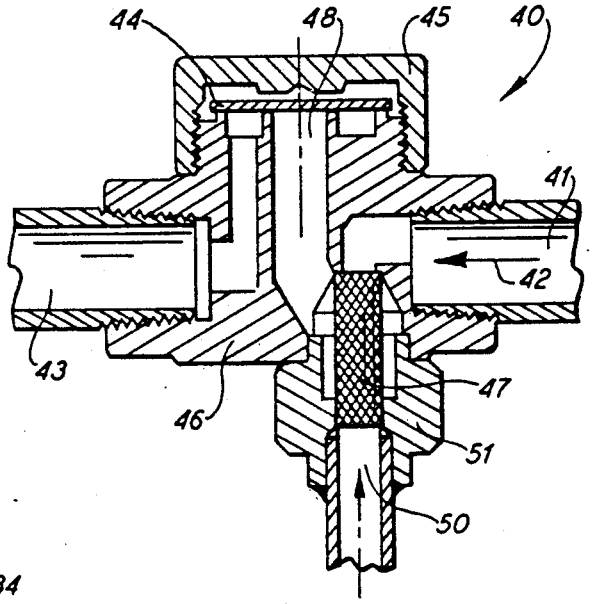
FIG. 4 is a cross sectional view of a steam trap used in accordance with the present invention.

Details of the steam trap valve 40, which in preferred embodiments is a disk-type steam trap, are shown in the cross-sectional view of FIG. 4. When liquid begins to flow through the input side 41 of the steam trap valve 40 in the direction indicated at 42, the liquid will pass through to the output side 43, but any gas will be trapped and will not flow through. The steam trap valve 40 is typically comprised of a disc 44, cap 45, body 46, screen 47, strainer 50, and strainer cap 51.

The trap works on the basis of fluid flow dynamics. The passage of gas underneath the disk 44 creates a low pressure area, a phenomenon commonly referred to as the "Bernoulli effect." This tends to force the disc 44 back down over the input channel 48, while any hot gas above the disc 44 also tends to force it down. Because the area of the disc over which gas above it can exert pressure is greater than the area of the input under it, a lower pressure above the disc 44 can balance off a higher pressure beneath it and thus close the entire steam trap. The trap is particularly effective and useful where pressurized steam passes through it; hence its common name. It will be understood by those familiar with gases, liquids, and their separation that devices other than the one shown may perform this function without departing from the scope of the invention or the claims.

In a preferred embodiment, a bypass 52 for each steam trap valve 40 is provided. The bypass pipe 52 connects to the strainer 50 of the steam trap valve 40, passes through a valve 53, and then connects to the upper or gas portion of the accumulator 14. The bypass 52 bleeds-off some of the gas pressure on the input side 41 of the steam trap valve and can enhance the proper operation of the system.

In a modified conventional shell ice maker such as the one illustrated in FIG. 2, The output side 43 of the steam trap valve 40 is connected by piping 57 to a liquid blowout collecting pot 54. The liquid then passes through the liquid return defrost valve 55, to the liquid return line 56, and into the top of the accumulator 14. The liquid return defrost valve 55 is a piston valve whereby a spring 60 normally holds the valve open. When the solenoid valve 63 opens and allows hot, high pressure gas from the compressor 10 to pass to the liquid return defrost valve 55, the discharge gas pressure acts on the top of the piston 62 to close the valve.

When operated in the above manner, the liquid return defrost valve 55 serves as a method of trapping gas in the evaporator 15. With the inclusion of a steam trap valve 40 in the third pipe 33, this function is already present. Therefore, the solenoid valve 63 may be closed at all times, which causes the liquid return defrost valve 55 to remain open.

The pilot operated hot gas valve 30 controls the flow of hot, high pressure gas from the compressor 10 to the first pipe 31 and to the piston valves 26 and 27. When the solenOid valve 64 is open, discharge gas pressure on the piston 65 holds the hot gas valve 30 closed. Closing the solenoid valve 64 relieves the discharge gas pressure and allows the hot gas valve 30 to open. The shut-off valve 66 is furnished as part of the piping and can be used to prevent the flow of hot, high pressure gas to the evaporator system.

To form the ice, water is pumped by the recirculating pump 70 through the valve 76, the nozzle 71 and is sprayed onto the exterior of the stainless steel freezing tubes 27 of the evaporator 15. The water freezes into ice in place on the tubes as the evaporator is cooled by the liquid refrigerant. Excess water falls into the drain pan 72 to be recirculated. The water supply in the drain pan 72 is supplemented and maintained by a make-up water source indicated at 73.

In order to harvest the ice, the freezing tubes 27 are warmed by hot gas until the ice slides off under the influence of gravity. The ice breaks into pieces as it strikes the ice bin 74. Means shown as the ice breaker motor 75 drives rotating mechanical knives or other mechanical apparatus in the ice bin 74 for breaking ice that falls from the evaporator into smaller pieces of ice if desired.

A typical ice making cycle is a timed cycle composed of two major processes. First, the ice is produced and second, the ice is harvested. This is accomplished by alternately circulating two-phase refrigerant in the evaporator in the liquid phase to cool the evaporator and in the gas phase to warm the evaporator.

To begin the ice production phase, the liquid line solenoid valve 20 is open to permit liquid refrigerant from the condenser 11 to flow into the accumulator 14. The solenoid valve 64 is open which causes the discharge gas pressure to hold the pilot operated hot gas valve 30 closed. Therefore, the piston valves 26, 28 for the liquid down leg 22 and gas return leg 23 are open, allowing liquid refrigerant to flow into the liquid-gas header 21 and down into the freezing tubes 27 of the evaporator 15. As the liquid refrigerant evaporates, it absorbs heat from the surroundings, cools the freezing tubes 27, and thereby encourages ice to form on the exterior of the tubes from the water spray directed at the tubes.

When sufficient ice has formed, a timing circuit switches to the harvesting or defrosting phase. Solenoid valve 64 is closed which relieves the discharge gas pressure on the piston 65 and opens the pilot operated hot gas valve 30. Hot, high pressure gas from the compressor 10 flows through the hot gas valve 30, the valve 58, the piping 59, and closes the piston valves 26, 28 for the liquid down leg 22 and gas return leg 23.

Hot, high pressure gas also flows down through the first pipe 31 to the gas cavity 34, up the second pipe 32, and into the liquid-gas header 21. The gas forces the liquid refrigerant out of the liquid chamber 35 of the freezing tubes and out of the liquid-gas header 21 through the third pipe 33. The liquid passes through the steam trap valve 40 on the third pipe 33, but the gas remains trapped in the evaporator. The liquid travels through the liquid blowout collecting pot 54 and liquid return defrost valve 55 to the liquid return line 56 and into the accumulator 14.

In a system without a steam trap valve 40 inserted in the third pipe 33, a timing circuit would open the solenoid valve 63 so that the discharge gas pressure would force down the piston 62 and close the liquid return defrost valve 55 after a sufficient period of time had passed so that all of the liquid refrigerant had been driven out of the freezing tubes 27 and header 21. The gas would thereby be trapped in the evaporator. However, some of the gas phase refrigerant would circulate through the entire system prior to the closing of the liquid return defrost valve 55.

The hot gas warms the evaporator and encourages the ice to fall from the freezing tubes 27. The steam trap valve 40 permits the gas phase refrigerant to be maintained in the evaporator without circulating the gas phase refrigerant entirely through the system, thereby causing a greater fraction of the gas phase refrigerant to condense in the evaporator than would condense there if the gas continued to flow without being trapped in the evaporator. Consequently, the heat transferred from the refrigerant to the evaporator is increased, reducing the time and energy required to harvest the ice and raising the efficiency of the ice making cycle. Because the gas phase refrigerant need not be circulated through the entire system, the work required by the compressor is also reduced.

Figure 5:
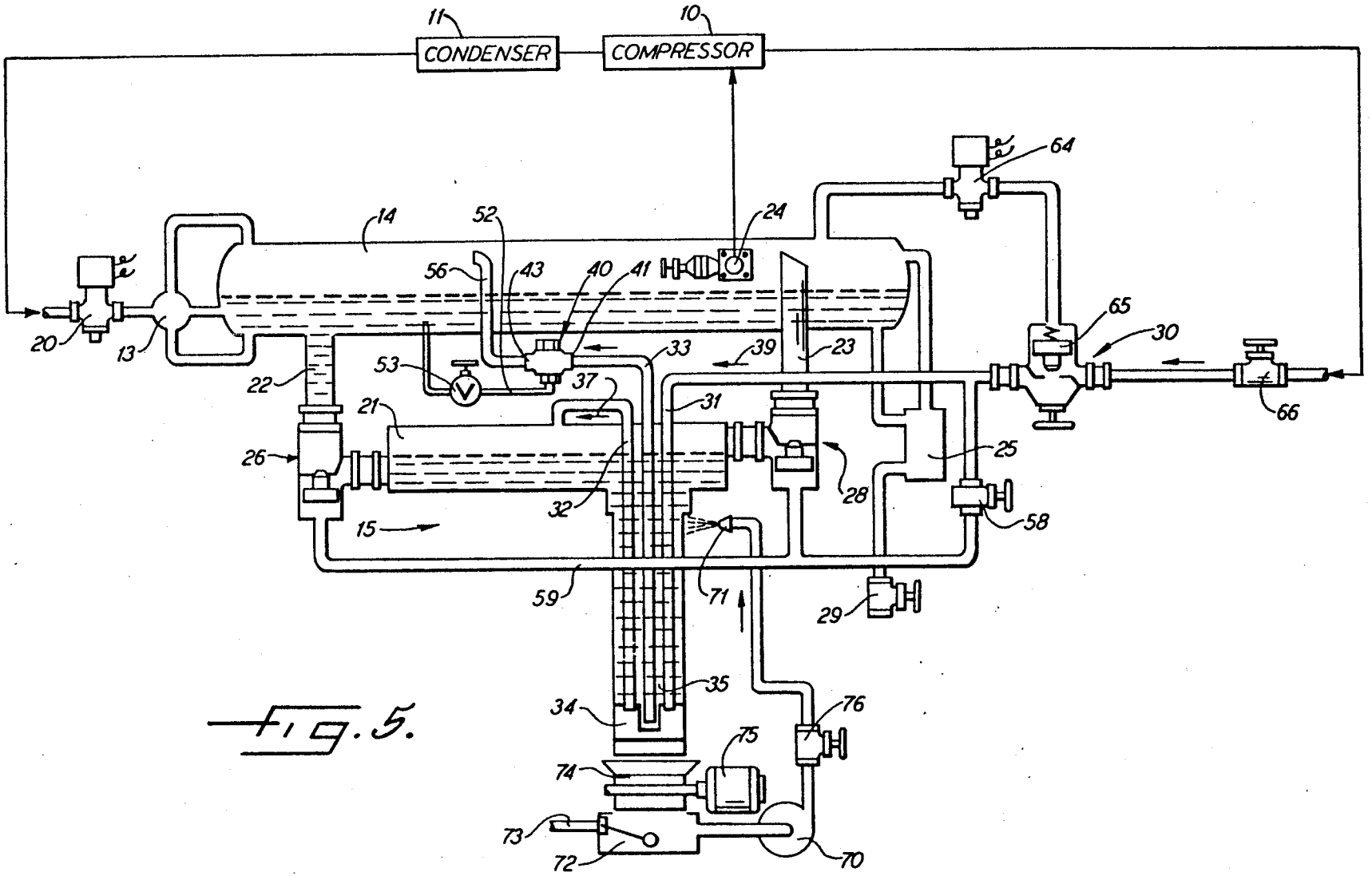
FIG. 5 is a schematic view of a shell ice maker that incorporates the present invention.

Because the steam trap valve 40 replaces the function of the liquid return defrost valve 55 in trapping the gas phase refrigerant during harvesting, the liquid return defrost valve is no longer needed for operation of the system. Hence, the liquid return defrost valve 55, the solenoid valve 63, the liquid blowout collecting pot 54, the liquid return line 56, and associated piping have been removed. FIG. 5 and FIG. 6 illustrate such an optimum configuration for a shell ice making system.

In the embodiment of a shell ice maker incorporating the present invention illustrated in FIG. 5 and FIG. 6, the third pipe 33 passes through the liquid-gas header 21 to the input side 41 of the steam trap valve 40. The output side 43 of the steam trap valve 40 is piped directly into the top of the accumulator 14. The steam trap valve bypass 52 connects to the strainer 50 of the steam trap valve 40, passes through a valve 53, and then connects directly into the accumulator 14. Shortening the path of the liquid return from the steam trap valve 40 to the accumulator 14 by eliminating the components mentioned above further reduces the time and energy required to harvest the ice and further increases the efficiency of the ice making cycle.

In the drawings and specification, there have been disclosed typical preferred embodiments of the invention and, although specific terms have been employed, they have been used in a generic and descriptive sense only and not for purposes of limitation, the scope of the invention being set forth in the following claims.

That which I claim is:

1. A method of improving the efficiency of ice production in cyclical ice making systems in which a two-phase refrigerant is circulated from a compressor, then to a condenser, and then to an evaporator, and in which the refrigerant is alternatively circulated into the evaporator in the liquid phase to cool the evaporator, and then circulated into the evaporator in the gas phase to warm the evaporator, and in which water is placed on the exterior of the evaporator to form ice when the refrigerant in the evaporator is in the liquid phase, following which the ice is warmed when the refrigerant is circulated into the evaporator in the gas phase to thereby encourage the ice to fall from the evaporator, the method comprising:

harvesting the ice by allowing the passage of liquids from the evaporator while substantially preventing the passage of gases therefrom to thereby maintain gas phase refrigerant in the evaporator for warming purposes without circulating gas phase refrigerant entirely through the system and to thereby reduce the work required by the compressor following any cyclical warming of said evaporator and to correspondingly increase the efficiency of the process.

2. A method of improving the efficiency of ice production in cyclical ice making systems in which a two-phase refrigerant is alternatively circulated into an evaporator in the liquid phase to cool the evaporator, and then circulated into the evaporator in the gas phase to warm the evaporator, and in which water is placed on the exterior of the evaporator to form ice when the refrigerant in the evaporator is in the liquid phase, following which the ice is warmed when the refrigerant is circulated into the evaporator in the gas phase to thereby encourage the ice to fall from the evaporator, the method comprising:

harvesting ice formed on the evaporator by trapping the gas phase refrigerant in the evaporator using a steam trap of the type that allows liquids to pass, but not gases, so that the gas phase refrigerant can be maintained in the evaporator without circulating the gas phase refrigerant entirely through the system to thereby condense a greater fraction of the gas phase refrigerant in the evaporator than would condense there if the gas phase refrigerant continued to flow without being trapped in the evaporator, and to thereby increase the heat transferred from the refrigerant to the evaporator and to the ice formed thereon and thus reduce the time and energy required to harvest the ice and correspondingly raise the efficiency of the entire ice making cycle.

3. A method according to claim 2 further comprising the steps of:

circulating a two phase refrigerant into an evaporator in the liquid phase to cool the evaporator; and placing water on the exterior of the evaporator to form ice when the refrigerant in the evaporator is in the liquid phase;

prior to the step of harvesting ice formed on the evaporator.

4. A method according to claim 3 wherein the step of placing water on the exterior of the evaporator comprises spraying water on the exterior of the evaporator.

5. A method according to claim 2 and further comprising mechanically breaking harvested ice into smaller pieces.

6. A method of improving the efficiency of ice production in shell ice making systems in which a two-phase refrigerant is circulated from a compressor, then to a condenser, then to a gas-liquid accumulator, and then to an evaporator that comprises a plurality of vertically oriented freezing tubes connected to a common header, and in which the refrigerant is alternatively circulated into the freezing tubes in the liquid phase to cool the freezing tubes, and then circulated into the freezing tubes in the gas phase to warm the freezing tubes, the method comprising:

circulating a two phase refrigerant into the freezing tubes in the liquid phase to cool the freezing tubes; and placing water on the exterior of the freezing tubes to form ice when the refrigerant in the freezing tubes is in the liquid phase; and harvesting ice formed on the freezing tubes by trapping the gas phase refrigerant in the tubes using a steam trap positioned between the header and the accumulator, and wherein the steam trap is of the type that allows liquids to pass, but not gases, so that the gas phase refrigerant can be maintained in the evaporator without circulating the gas phase refrigerant entirely through the system to thereby condense a greater fraction of the gas phase refrigerant in the evaporator than would condense there if the gas phase refrigerant continued to flow without being trapped in the evaporator, and to thereby increase the heat transferred from the refrigerant to the evaporator and to the ice formed thereon and thus reduce the time and energy required to harvest the ice and correspondingly raise the efficiency of the entire ice making cycle.

7. A method according to claim 6 wherein the step of trapping the gas phase refrigerant in the tubes using a steam trap comprises trapping the refrigerant using a plurality of steam traps with one respective steam trap trapping the refrigerant in each respective tube.

8. An ice maker for improving the efficiency of ice production in cyclical ice making techniques in which a two-phase refrigerant is circulated from a compressor, then to a condenser, and then to an evaporator, and in which the refrigerant is alternatively circulated into an evaporator in the liquid phase to cool the evaporator, and then circulated into the evaporator in the gas phase to warm the evaporator, the ice maker comprising:

means positioned between the evaporator and the compressor for allowing the passage of liquids from the evaporator while substantially preventing the passage of gases to thereby maintain gas phase refrigerant in the evaporator for warming purposes without circulating gas phase refrigerant entirely through the system and to thereby reduce the work required by the compressor following any cyclical warming of said evaporator and to correspondingly increase the efficiency of the process.

9. An ice maker according to claim 8 wherein said means for allowing the passage of liquids from the evaporator to the compressor while minimizing or stopping the passage of gases comprises a steam trap.

10. An ice maker for improving the efficiency of ice production in cyclical ice making techniques in which a two-phase refrigerant is alternatively circulated into an evaporator in the liquid phase to cool the evaporator, and then circulated into the evaporator in the gas phase to warm the evaporator, the ice maker comprising:

a compressor for receiving a two phase refrigerant in a lower pressure gas phase and then increasing the pressure of the gas phase refrigerant;

a condenser in fluid communication with said compressor for transferring heat previously absorbed by the refrigerant away from the apparatus while changing the refrigerant from the gas phase to the liquid phase;

an evaporator in fluid communication with said condenser and with said compressor for receiving refrigerant in the liquid phase from said condenser and then allowing the refrigerant to change from the liquid phase to the gas phase while absorbing heat from the evaporator and its surroundings to thereby cool the evaporator and its surroundings;

means for circulating refrigerant from said compressor to said condenser, from said condenser to said evaporator, and from said evaporator to said compressor;

means for placing water in thermal communication with said evaporator for cooling and freezing the water into ice;

means for alternatively circulating gas phase refrigerant to said evaporator to cyclically warm said evaporator from time to time as may be desirable; and a steam trap positioned in said refrigerant circulating means between said evaporator and said condenser for allowing the passage of liquids from said evaporator to said compressor while substantially preventing the passage of gases to thereby maintain gas phase refrigerant in said evaporator for warming purposes without circulating gas phase refrigerant entirely through the system and to thereby reduce the work required by the compressor following any cyclical warming of said evaporator and to correspondingly increase the efficiency of the process.

11. An ice maker according to claim 10 wherein said steam trap comprises a disk-type steam trap.

12. An ice maker according to claim 11 wherein said steam trap comprises a body, an inlet in said body, an outlet from said body, and a disk between said inlet and said outlet for being seated against said inlet when the passage of gas past the inlet side of said disk creates a low pressure area so that higher pressure gas on the outlet side of said disk tends to force said disk over said inlet to thereby close said inlet to the flow of gases from said inlet to said outlet while permitting the flow of liquids therebetween.

13. An ice maker according to claim 10 wherein said evaporator comprises a vertically oriented freezing tube and said means for placing water in thermal communication with said evaporator comprises a water spray directed at the exterior of said stainless steel tube so that the water forms ice when the refrigerant in the stainless steel tube evaporator is in the liquid phase, and for allowing a portion of the ice that forms on the exterior of said tube to melt when said tube is cyclically warmed by gas phase refrigerant so that substantially all of the ice on the tube is encouraged to fall from the tube when said evaporator is cyclically warmed.

14. An ice maker according to claim 13 and further comprising means for breaking ice that falls from said evaporator into smaller pieces of ice.

15. An ice maker according to claim 10 wherein said evaporator comprises a plurality of said vertically oriented freezing tubes in communication with a common gas-liquid header.

16. An ice maker according to claim 15 and further comprising a gas-liquid accumulator in fluid communication with said header and between said evaporator and said compressor.

17. An ice maker according to claim 16 wherein said steam trap is positioned between said header and said accumulator.

18. An ice maker according to claim 17 and further comprising a plurality of steam traps with a separate steam trap in communication with each of said freezing tubes.

19. An ice maker according to claim 16 wherein said evaporator is in direct communication with said accumulator and said steam trap is positioned between said evaporator and said accumulator.

20. An ice maker according to claim 19 and further comprising a bypass valve between said steam trap and said accumulator.

* * * * *